US011101086B2

(12) United States Patent
Oehler et al.

(10) Patent No.: US 11,101,086 B2
(45) Date of Patent: Aug. 24, 2021

(54) ELECTRICAL SWITCH

(71) Applicant: Lisa Dräxlmaier GmbH, Vilsbiburg (DE)

(72) Inventors: Fabian Oehler, Munich (DE); Michael Wortberg, Dorfen (DE)

(73) Assignee: Lisa Dräxlmaier GmbH, Vilsbiburg (DE)

( * ) Notice: Subject to any disclaimer, the term of this patent is extended or adjusted under 35 U.S.C. 154(b) by 0 days.

(21) Appl. No.: 16/649,970

(22) PCT Filed: Sep. 21, 2018

(86) PCT No.: PCT/EP2018/075562
§ 371 (c)(1),
(2) Date: Mar. 23, 2020

(87) PCT Pub. No.: WO2019/057870
PCT Pub. Date: Mar. 28, 2019

(65) Prior Publication Data

US 2020/0227220 A1 Jul. 16, 2020

(30) Foreign Application Priority Data

Sep. 22, 2017 (DE) ..... 102017122008.9

(51) Int. Cl.
*H01H 33/46* (2006.01)
*H01H 33/06* (2006.01)
*H01H 33/42* (2006.01)

(52) U.S. Cl.
CPC ..... *H01H 33/46* (2013.01); *H01H 33/06* (2013.01); *H01H 33/42* (2013.01)

(58) Field of Classification Search
CPC ..... H01H 9/32; H01H 33/06; H01H 33/40; H01H 33/42; H01H 33/46
(Continued)

(56) References Cited

U.S. PATENT DOCUMENTS 6,084,756 A * 7/2000 Doring ..... G01R 31/3277 324/527
6,724,604 B2 * 4/2004 Shea ..... H01H 79/00 361/118
2014/0054271 A1 2/2014 Weiden

FOREIGN PATENT DOCUMENTS

DE 29516057 U1 1/1996
DE 102014226131 6/2016
EP 2784795 A1 10/2014

OTHER PUBLICATIONS

English Language Machine Translation of DE102014226131A1.
(Continued)

*Primary Examiner* — Kevin J Comber
(74) *Attorney, Agent, or Firm* — Jacob Eisenberg

(57) ABSTRACT

An electrical switch for interrupting a current path. The switch includes a contact point formed from a first and a second contact piece mounted such that it can move about a rotation axis. The contact point is closed when the two contact pieces are in contact and is electrically opened when the two contact pieces are not in contact. The electrical switch includes an actuator unit and an electrically non-conductive separating element which can be moved in a translatory manner by means of the actuator unit and is designed to isolate the two contact pieces and then to keep the two contact pieces apart. The actuator unit includes a movement element mechanically coupled to the separating element, a drive device designed to move the movement element in order to close the contact point, a device for generating and/or storing kinetic energy and an electromagnetic actuator.

19 Claims, 6 Drawing Sheets

(58) Field of Classification Search
USPC ..... 361/139
See application file for complete search history.

(56) References Cited

OTHER PUBLICATIONS

English Language Machine Translation of EP2784795A1.
English Language Machine Translation of DE29516057U1.
International Search Report Translation.

* cited by examiner

ELECTRICAL SWITCH

CROSS REFERENCE TO RELATED APPLICATIONS

This application is a national phase application of International Application No. PCT/EP2018/075562, filed on Sep. 21, 2018, and claims the priority benefit of German Application 102017122008.9, filed on Sep. 22, 2017, the content of both of which is incorporated herein by reference.

TECHNICAL FIELD

The present disclosure relates to an electrical switch for interrupting a current path, in particular a DC voltage supply in a motor vehicle.

BACKGROUND

The present invention is described in the following mainly in connection with switching elements for vehicle electrical systems in the range of 48 volts or high voltage (HV), above 60 volts or the HV voltage range between 400 volts and 1000 volts which is usual for motor vehicles. However, the invention can be used for all applications in which electrical loads are switched.

At present, the HV battery in HV vehicle on-board electrical systems is separated, in motor vehicles, on all poles, by a total of two high-voltage contactors. The high-voltage contactor is on the positive side additionally connected by an HV fuse for protection. In front of the contactor, a pyrofuse (pyrotechnic fuse) can be provided on this side, which, as a technologically diverse component to a conductor in terms of the diversity required by ASIL, can take over the irreversible separation of "hard" short-circuits (usually up to 16 kA). In addition, high-voltage contactors are used on the vehicle side for switching the charging currents on all poles.

One challenge in high-voltage protection is the electrical arcs that occur and the appropriate measures to suppress them. With regard to HV contactors, blowout magnets for increasing the arc length in connection with the mechanism of "pressing the arc against a wall" and the use of an inert gas as protective gas for arc extinction are particularly well known. In both cases, however, the short-term "tolerance" of the arcs leads to a relatively low or insufficiently large maximum current carrying and separating capacity of high-voltage contactors, resulting from the maximum permissible energy input into the component during switching.

There are some challenges in the application in the motor vehicle. For example, the use of an HV fuse requires large cable cross-sections due to its inertia with small overcurrents and dynamic current profiles. The contactors, which can be used for a power range of U~450-1000 V and I~400 A have large actuators to ensure the required shock resistance for the heavy contacts required. The large coils of the actuators make the contactors relatively expensive and require relatively high holding currents with the associated high-power losses. The contactors known in the automotive sector do not have the ability to separate currents>6 kA, as otherwise the energy occurring in the switching arcs (switching time ~10 ms) would lead to the destruction of the contactor. In the separation process, an arc is drawn between the fixed and actuated contact at both contact points for known contactors, which burns until suppressed at the contact point. This leads to damage with an accompanying increase in the contact resistance at the contacts. Levitation (electromagnetic contact lift-off) causes the contacts to weld at high currents.

In addition to a significant increase in the switching speed, the challenge and requirement at the same time is the rapid interruption of the switching arc by a suitable mechanism. It is also important to prevent such an arc from forming on the contact surface or area of the closed contactor. In addition, if the arc is interrupted very quickly, a voltage increase is to be expected, which may have to be counteracted with a parallel-connected component for overvoltage limitation.

SUMMARY

In view of limitations in the related art, an object of certain embodiments of the disclosure may be to create an electrical switch which solves the above-mentioned challenges or a part of them, or at least provides an improvement for them by using the simplest possible means.

The above and other objects may be attained by the implementations consistent with the independent claim. Further advantageous embodiments of the invention are set out in the dependent claims, the description and the accompanying figures.

Objects and advantages of the disclosed embodiments may be realized and attained by the elements and combinations set forth in the claims. However, embodiments of the present disclosure are not necessarily required to achieve such, exemplary objects and advantages, and some embodiments may not achieve any of the stated objects and advantages.

The electrical switch described below is suitable for interrupting a current path of a voltage supply in a motor vehicle. The electrical switch comprises a contact point formed by a first contact piece and a second contact piece. The contact pieces can also be referred to simply as contacts. The second contact piece is mounted so that it can move about a rotation axis. The contact point is electrically closed when the two contact pieces' touch each other in the contact point. Accordingly, the contact point is electrically open if the two contact pieces do not touch each other or if no current flows from the first contact piece to the second contact piece, or vice versa. Furthermore, the electrical switch also includes an actuator unit and a separating element. The separating element has two functions. Firstly, it lifts the contact pieces apart from each other at the moment of penetration between the two contact pieces, and secondly, it acts as an insulator between the two contacts as soon they are penetrated. Due to this property, the dielectric strength for this arrangement is higher than for classical contactors or relays. The actuator unit is designed such that translationally movable, electrically non-conductive separating elements can be moved in a first direction of movement and alternatively in a second direction of movement opposite the first direction of movement in order to separate the two contact pieces from each other, to open the electrical switch or to interrupt the current path or to close the open switch again and thus to close the current path again. For this purpose, the actuator unit includes a motion element, a drive device, a device for generating and simultaneously or alternatively storing a kinetic energy and an electromagnetic actuator. The movement element is mechanically coupled to the separating element of the electrical switch, so that movement of the moving element also means a corresponding movement of the separating element and vice versa. The drive device is set up to move the moving element in the first direction of movement to close the contact point. The device for generating and simultaneously or alternatively storing kinetic energy in the form of potential energy is arranged to move the moving element and thus the separating element in the second direction of movement opposite to the first direction of movement in order to open the contact point. The electromagnetic actuator is designed to assume three operating states.

In the following, an explanation is based on the assumption of a monostable electrical switch which, if it is not activated, interrupts the electrical circuit. If the electromagnetic actuator is not energized, the moving element is free to move and can be moved in the second direction of movement by the device for generating and simultaneously or alternatively storing a kinetic energy in order to open the contact point or keep it open. From this operating state, the moving element and the separating element can be moved in the first direction of movement by coupling the moving element with the drive device and thus closing the separation point. In this open position, the electromagnetic actuator can now lock the moving element and/or the separating element—as long as the electromagnetic actuator is energized. This is reflected in the at least three operating states of the electromagnetic actuator. In a first operating state, the electromagnetic actuator blocks movement of the moving element in the second direction of movement or the electromagnetic actuator locks the moving element in a defined position. Thus, the moving element is held in a rest position to keep the contact point closed. In the second operating state, the electromagnetic actuator is set up to move the moving element in the direction of the drive device and thus mechanically couple the drive device with the moving element. If the drive device is mechanically coupled to the moving element, the moving element can be moved in the first direction of movement by means of the drive device to close the contact point. In a third operating state, the electromagnetic actuator is designed to release the moving element. Thus, neither the electromagnetic actuator blocks a movement of the moving element, nor is that moving element mechanically coupled with the drive device. Therefore, in the third operating state of the electromagnetic actuator, the device for generating and simultaneously or alternatively storing kinetic energy in the form of potential energy can be moved in the second direction of movement. This rapid movement of the moving element and the separating element coupled with it opens the contact point or separates the two contact pieces from one another and then keeps them separate. With the electrical switch described here, a contact of the contactor is not actuated as known from the prior art, but a separating element is actuated. This separating element is moved between the contact pieces, which is why one of the contact pieces is further movable. Furthermore, it was recognized that the closing of a contactor does not have to take place at the same speed as the opening. In the case of the electrical switch described here, the contact is therefore closed by the drive device, which is designed, for example, as an electric motor with a gearbox, and opened by means for generating and/or storing kinetic energy in the form of potential energy, which is designed, for example, as a preloaded spring.

Furthermore, the electrical switch described here does not require a large solenoid which would have to permanently maintain the voltage of the release spring when the contact is closed. Instead, only a smaller electromagnetic actuator is required, which can lock the separating element in a defined position when the contact is closed. An electromagnetic actuator can be understood as a reluctance actuator, for example, a solenoid. The linear solenoid can be designed as a monostable linear solenoid. If the solenoid is a monostable solenoid, the electrical switch is also monostable. Alternatively, if the solenoid is a bistable solenoid, the electrical switch is also correspondingly bistable. This property is therefore directly transferred to the entire electrical switch.

With the electrical switch at hand, a separating element is actuated as described above. When switched on, the separating element between the contacts is pulled out. The flexible contact in the form of the second contact piece is guided by a spring, in particular a contact pressure spring, to the separating element, thus "gently" contacting the first contact piece. Contact bounce is completely prevented or at least greatly reduced. In this way, the behavior known from contactors when closing the contact due to the accelerated impact of the moving contact bridge of the rigid contact, the generally known contact bounce, can be avoided, in which the contact bridge lifts off slightly a few more times, creating small arcs which lead to increase wear in normal operation and potentially increase the contact resistance after repeated switching cycles.

Furthermore, the electromagnetic actuator may include an energy storage drive. The energy storage drive can be designed as a spring. The energy storage drive supports the monostable property of the electromagnetic actuator, as it is pulled away from the movement device in the de-energized state. In other words, the actuator (pin of the solenoid) can be retracted when no current is applied. Thus, switching off the supply voltage for the electromagnetic actuator results in the release of the moving element.

As already stated, the electrical switch described here in contrast to the solutions known from the prior art, does not actuate a contact, but a separating element. However, a contact piece is designed to be movable, but geometrically arranged in such way that lift-off due to the effect of levitation does not occur in the event of a short circuit, since a large part of the levitation force can be absorbed by the contact itself. The levitation force is the component of the following forces that acts normally at the contact point to the contact system, i.e. the component that causes the moving contact to lift off (levitation/approx. "free floating"). This force is always made up of two parts: Holm's narrow force and Lorentz force. The first force (Holms' constriction force) is generated by antiparallel current filaments at the so-called a spots, i.e. the actual contact points, and, in theory, acts exactly normal to the fixed, first contact piece. The vectoral component, which then has a lifting effect for the flexible contact, is thus dependent on the angle in the closed state. The second force is the classical known Lorentz force, which occurs when electric charges move in a stationary magnetic field. In the case of the contactor design described here, this force does not lift off, but regardless of the current direction even counteracts the component of Holm's narrow force that leads to a contact lift-off. This is a significant difference to contactors from the prior art, where both described components have a "100%" lift-off effect.

In the design form, a section of the separating element runs at an angle to the direction of movement of the separating element. The direction of movement of the separating element essentially corresponds to the main direction of extension of the separating element. The sloping section of the separating element thus has the shape of a top, ramp or bevel. Such a top of the separating element separates the second contact piece from the first contact piece via the when moving in the second direction of movement. This facilitates the separation process and the contact piece can slide over the top.

In one version, the separating element essentially comprises a ceramic material or the separating element is essentially made of a ceramic material. This creates a high electrical insulation capacity.

Optionally, in one version, the sloping section of the separating element is made of conductive resistance material. A conductive top on the separating element also prevents the formation of an arc at the contact surface or area of the closed switch. A switching arc only occurs when the conductive top has moved completely past the flexible contact, i.e. the second contact piece. So a switching arc between the movable second contact piece and the conductive top arise. The conductive top is defined as the section of the separating element that is at an angle to the direction of the movement of the separating element. The conductive resistance material is either exclusively applied to the surface of the corresponding section or the section is completely made of a corresponding conductive resistance material, for example a metal.

By appropriately designing the resistance material and the resulting conductive top, the electrical resistance can be designed in such a way that it fulfills the function of a precharging circuit. Advantageously, transients can be avoided at high inrush currents, thus protecting both the electrical switch and downstream electrical loads. If the resistance value of a separating element in the area of the top corresponds to the resistance of an appropriately designed precharging resistor, precharging can be carried out by first flowing the inrush current via this top and only closing the switching contacts after a defined time.

Furthermore, the electrical switch can have an electrically insulating base plate into which, when the separating element moves in the second direction of movement, the top or the inclined section of the separating element is immersed after the separation of the two contact pieces. For this purpose, the base plate may have a recess which essentially corresponds to the shape of the top of the separating element and is shaped in such way that the top of the separating element essentially completely fills the recess when the top of the separating element is immersed in the base plate. A recess can thus be understood to be a hole or a depression in the base plate.

To suppress an arc, the separating element then dips into the recess, or in other words a depression in the base plate after opening the contact point. There the arc is strongly cooled down and collapses. Thus, in comparison to the prior art, a version of the electrical switch described here can be made without inert gas and/or blow magnets. This is advantageous because when using a shielding gas, sufficient gas pressure must also be guaranteed (to?) "end of life", which leads to high sealing requirements. Since permanent magnets are also expensive, it is also advantageous to do without them. All in all, the functional efficiency can be improved, and costs can be reduced at the same time. By eliminating the blowout magnet used for arc suppression in the prior art, there is also no preferred direction of the electrical switch. The electrical switch described here has the same current carrying capacity and current switching capacity in both flow directions. This means that charging processes can also be efficiently protected.

The drive device can be designed as an electric motor or as an electric motor with a gearbox. The drive device may comprise a gear wheel which can be mechanically coupled to the motion element in order to convert a rotational motion of the drive device into a translational proportional motion of the motion element. Alternatively, a spindle is conceivable as a converter is one of a rotary into a translational movement.

The device for generating and simultaneously or alternatively storing kinetic energy is a spring, in particular a helical spring in the form of a screw. This can be a compression or tension spring, with the spring acting in the direction of the second direction of movement to open the contact point quickly.

The movement element can be a rack. Thus, a gear wheel of the drive device can be mechanically coupled to the rack by meshing the teeth of the rack with the teeth of the gear wheel.

As already stated, the electromagnetic actuator is designed to block movement of the moving element in the second direction of movement in the first operating state. In order to achieve this, the toothed rack may have a bore or recess which is shaped such that an element of the electromagnetic actuator, for example a locking bolt, engages in it when the electromagnetic actuator is in its first operating state. Depending on the shape, movement of the movement element in the second direction of movement or in both directions of movement is thus blocked.

A control device for controlling the operating states of the electromagnetic actuator as well as the drive device may be integrated in the electrical switch in the form of corresponding electronics. Such a control device has corresponding control connections.

As part of the control device or as a separate device, a condition monitoring device can be provided, which determines the condition of the electrical switch by means of a terminal current measurement. Alternatively, condition monitoring can also be performed by detecting the position of the locking element from the electromagnetic actuator.

Furthermore, the electrical switch can have a precharge circuit which includes in particular a resistor in combination with an electromechanical relay or a power semiconductor. This protects capacitors of the high-voltage on-board electrical system in particular from steep current transients, as the capacitors contained in the system otherwise act as short-circuits in the non-steady state. In a special design of the electrical switch, it is even possible to dispense completely with a precharging circuit, whereby the function is taken over by the electrical switch (contactor) itself. This would be conceivable, firstly, if the value of the resistance of a separating element in the area of the top corresponds to that of the external resistance described above; and the precharging was achieved by the inrush current initially flowing via this top and afterward for a defined time (e.g. after 300 ms) the separating element is completely "extended" and thereby closing the switch contacts. Secondly, there is a potential for precharging to be dispensed; and a direct, hard connection can be made if the DC link capacitors used have an appropriate pulse load capacity. Conventional contactors wear out after approx. 40 to 100 switching cycles during hard switching into a capacitance, since the bouncing during switching with the associated arcing effect causes considerable wear of the contact surface or areas. This effect does not occur with the inventive arrangement, as bouncing is avoided when the device is switched on.

Compared to the solutions known in the prior art, a design of the electrical switch described here achieves an overall significantly improved disconnection capability of "soft" and "hard" short circuits at the same speed, so that a previously always downstream HV fuse can be omitted, which in turn enables the reduction of cable cross sections.

BRIEF DESCRIPTION OF THE DRAWINGS

Further advantages, features and details of the various embodiments of this disclosure will become apparent from the ensuing description of a preferred exemplary embodiment and with the aid of the drawings. The features and combinations of features recited below in the description, as well as the features and feature combination shown after that in the drawing description or in the drawings alone, may be used not only in the particular combination receited, but also in other comnbinations on their own, with departing from the scope of the disclosure.

In the following, an advantageous example of the present disclosure is explained with reference to the accompanying figures. Wherein.

The figures are merely schematic representations and only serve to explain the disclosure. The same or similar acting elements are consistently marked with the same reference signs.

DETAILED DESCRIPTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that "at least one of "A, B, and C" should be understood as including only one of A, only one of B, only one of C, or any combination of A, B, and C.

Figure 1:
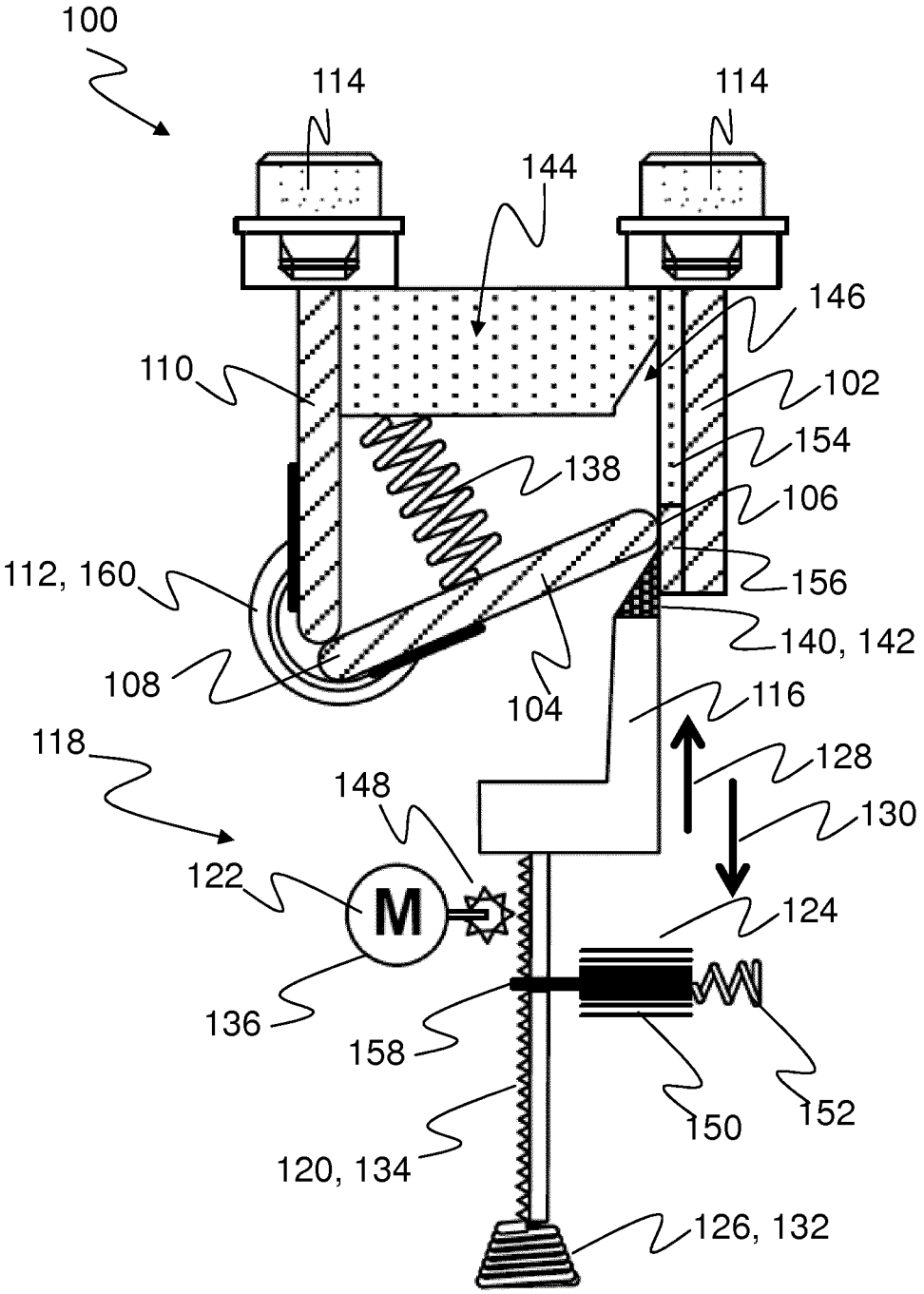
FIG. 1-3 is a schematic representation of an electrical switch according to a first example of the execution of the present disclosure.

FIG. 1 shows an electrical switch 100 according to a first design example. The electrical switch 100 has two contact pieces 102, 104, which make contact in a contact point 106. The electrical switch is thus closed. The first contact piece 102 is rigid. The second contact piece 104 is arranged so that it can move about a rotation axis 108. Furthermore, the switch has a third contact piece 110. The second contact piece 104 and the third contact piece 110 are electrically connected to one another. This is achieved by a flexible line 112, one end of which is connected to the second contact piece 104 and the other end to the third contact piece 110. On the first contact piece 104 and on the third contact piece 110, a screw contact 114 is provided for connection to a current path, for example a power supply in a motor vehicle. Furthermore, the electrical switch 100 comprises an electrically non-conductive separating element 116 and an actuator unit 118 connected to the separating element 116. The separating element 116 is set up to be moved in translationally. Furthermore, the separating element 116 is designed to separate the two contact pieces 102, 104, i.e. the first contact piece 102 and the movable second contact piece 104 from each other and then to keep them apart. The actuator unit 118 comprises a motion element 120, a drive device 122, an electromagnetic actuator 124 and a device 126 for generating and/or storing a kinetic energy. The movement element 120 is mechanically coupled with the separating element 116. Thus, a movement of the moving element 120 is directly transmitted to the separating element 116 and vice versa. The drive device 122 is set up to move the moving element 120 in a first direction of movement 128 to close the contact point 106. The device 126 for generating and/or storing a kinetic energy is arranged to move the moving element 120 and/or the separating element 116 in a second direction of movement 130 in order to open the contact point. The first direction of movement 128 and the second direction of movement 130 point in two mutually opposite directions.

Figure 2:
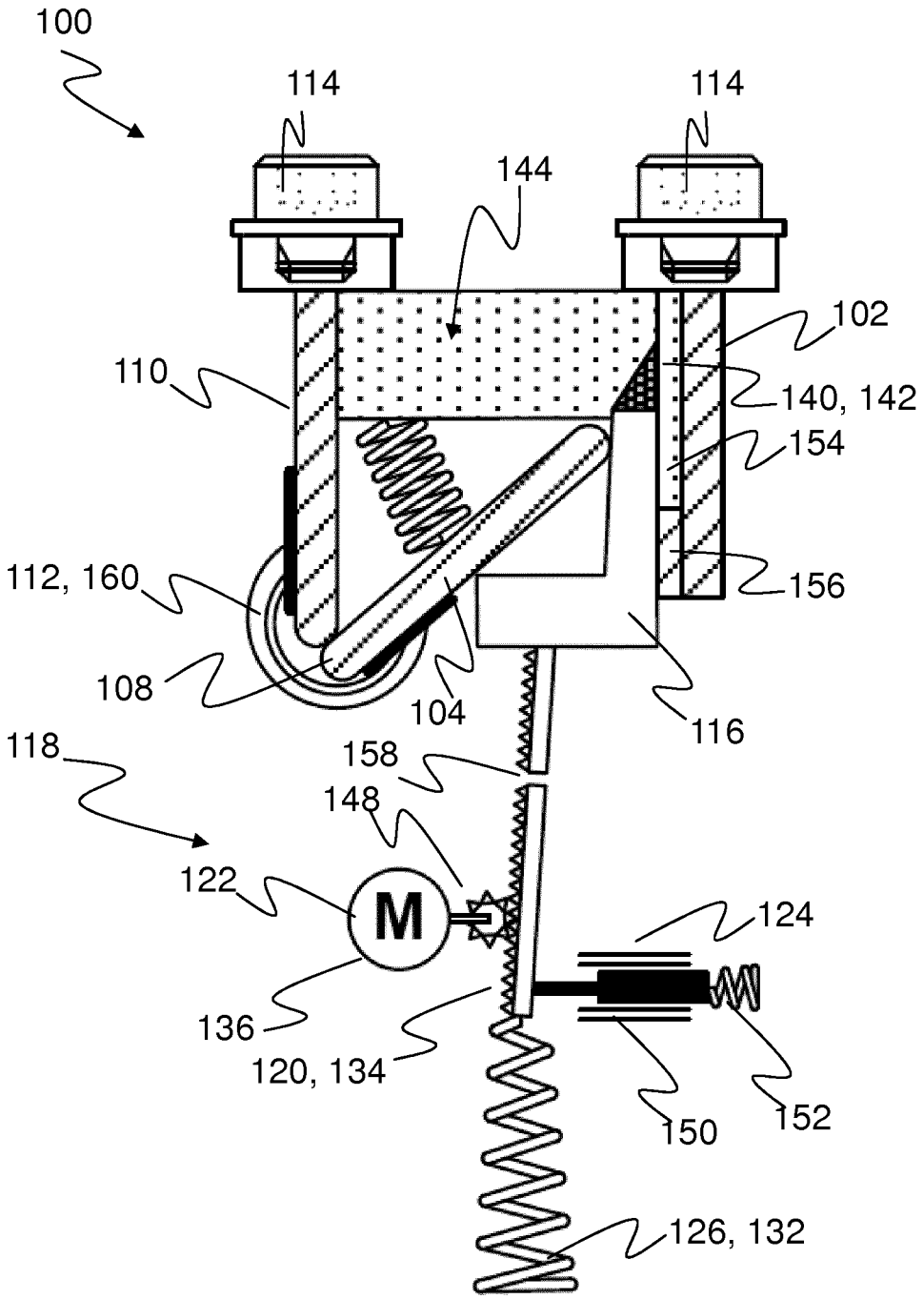
Figure 3:
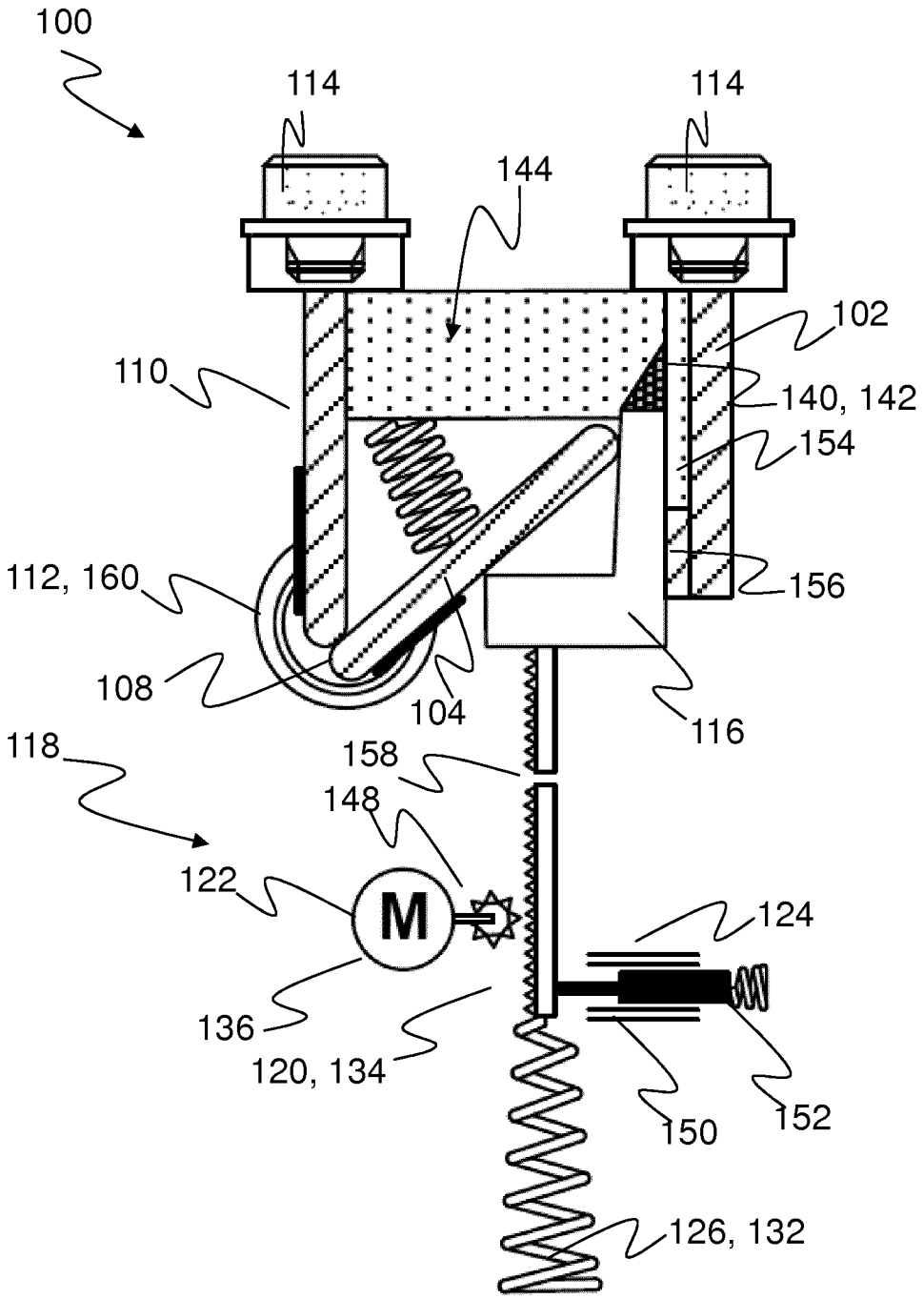

The electromagnetic actuator 124 has at least three operating states, as well as transitions from one of these operating states to one of the other operating states. The three operating states are shown in FIG. 1 to FIG. 3, in other words, these figures differ in that the operating state of the electromagnetic actuator 124. FIG. 1 shows the electromagnetic actuator 124 in a third operating state in which the movement of the moving element 120 is enabled. In this state, the device 126 for generating and/or storing kinetic energy acts directly on the moving element 120 and indirectly on the separating element 116 or, in a design example not shown, directly on the separating element 116 and indirectly on the moving element 120 via the mechanical coupling of the two. FIG. 2 shows the electromagnetic actuator 124 in a second operating state, in which the electromagnetic actuator 124 presses the moving element 120 in the direction of driving device 122, whereby the driving device 122 is mechanically coupled to the moving element 120. Via a appropriate control of the drive device 122, the moving element 120 can now be moved in first direction of movement 128, as a result of which the contact point 106 closes. FIG. 3 finally shows the first operating state of the electromagnetic actuator 124 in which the latter blocks a movement of the moving element 120 and holds the moving element 120 in a defined position. The device 126 designed as a spring 132 for generating and/or storing kinetic energy is kept under a preload. In other words, the moving element 120 is thus held in a rest position, leaving the contact point 106 closed and thus the two electrical contact pieces 102, 104 create an electrical connection between the two screw contacts 114.

In the design example shown in FIG. 1 to FIG. 3, the moving element 120 is designed as a toothed rack 134. The drive device 122 is designed as one electric motor 136. Furthermore, when the contact point 106 is closed, the movable second contact piece 104 is pressed against the first contact piece 102 by the restoring force of a contact pressure spring 138.

For the better suppression of arcing during an opening process, the design example shown shows that the separating element 116 has a section 140 on the side facing the second contact piece 104, which runs at an angle to the direction of movement of the separating element 116. This sloping section 140 is also known as top 142, ramp, wedge or bevel. In the particular design example, as shown in FIG. 1 to FIG. 3, the diagonal section 140 of the separating element 116, designed as a top 142, is made of conductive resistance material in order not to generate an arc in the initial phase of the contact separation, but to allow current to flow for a short time. The current flow does not initially break off and thus no arc is created. Only when the top 142 has moved completely between the first and second contact pieces 102, 104 does the advancing section of the separating element 116 change to an insulating, electrically non-conductive material section. At this point, the top 142 dips into a base plate 144 of the electrical switch 100. The base plate 144 is electrically insulating and has a recess 146 adapted to the shape of the top 142 and is shaped in such a way that the top 142 of the separating element 116 substantially completely fills the recess 146 when the top 142 is immersed in the base plate 144 as described here.

In addition to the electric motor 136, the drive device 122 further includes a gear wheel 148. In a design example, gear wheel 148 can also be understood as a gearbox. The teeth of the gear wheel 148 are shown in FIG. 2 i.e. in the second operating state of the electromagnetic actuator 124 with the teeth of the rack 134.

The electromagnetic actuator 124 is essentially a linear solenoid 150, with an additional tension spring 152. The tension spring 152 is designed to move the armature bolt of the solenoid 150 in the direction away from the toothed rack 134 when the solenoid is not energized in order to release it. This ensures that the electromagnetic actuator 124 is monostable. This also sets "off" as the safe state of the electrical switch.

If the spring 152 is not used, the solenoid is bistable, which would also be directly transferred to the whole contactor.

The first contact piece 102 has an insulation jacket 154 which is interrupted in the region of the contact point 106 to make room for a contact area 156. The contact area 156 penetrates the insulation jacket 154 in an electrically conductive manner. This creates an electrical contact between the second contact piece 104 and the contact area 156. The contact area 156 is part of the first contact piece 102, so that electrical contact can still be established between the first contact piece 102 and the second contact piece 104. The insulation jacket 154 helps prevent or reduce electric arcs. The insulation jacket 154, for example, is made of a plastic or a ceramic material.

The movement element 120 or the toothed rack 134 has a recess 158 or an opening in which an element of the electromagnetic actuator 124 engages in the corresponding operating mode, i.e. the third operating state, to prevent movement of the moving element 120 or the rack 134. In one version, the solenoid 150 has an armature bolt with the section protruding from the solenoid 150, which protrudes from the lifting solenoid 150 on the side opposite the tension spring 152. This protruding section is shaped to engage in the recess 158 in the third operating state, thus blocking the movement of the moving element 120.

Another embodiment of the electrical switch 100 is further described hereinbelow. For example, a device for switching direct currents, such as the electrical switch 100 shown here, is suitable for establishing and disconnecting a power supply in a motor vehicle under load. The arrangement has a switching range and an actuator range. There are two contacts (first contact piece 102 and second and third contact pieces 104, 110) in the switching area, whereby one contact (second and third contact pieces 104, 110) is deflected via a flexible connection 160. A spring or contact pressure spring 138, particularly designed as a helical or torsion spring, presses the flexible contact part (second contact piece 104) against the other contact (first contact piece 102). Depending on the design of the flexible contact, the attachment to the second contact can be point, zone, area or line shaped. This second contact (first contact piece 102) is rigid and has an upstream surface (contact area 156) where the flexible contact (second contact piece 104) rests when the electrical switch 100 is closed. Beyond this contact area 156, the first contact piece 102 is surrounded by an insulating material, particularly plastic. This ensures that the contact is separated on both sides as the process continues.

In the actuator area there is an electric motor 136 with a gear not explicitly shown and an electromagnetic actuator 124, especially a reluctance actuator (solenoid 150), as well as a toothed rack 134 and a further spring 132, preferably in the form of a screw. The rack 134 is connected to a separating element 116. The separating element 116 has lateral guides not shown or is passively guided laterally and can thus be moved between the contact pieces 102, 104. The spring 132 can be connected either directly or indirectly via the toothed rack 134 to the separating element 116. The separating element 116 is made of a non-electrically conductive material, preferably ceramic or glass, but its top 142 in a design example is made of an electrically conductive material, preferably metal.

The gearbox of the electric motor 136 or the gear wheel 148 and the rack 134 do not mesh with one another in the de-energized state. By energizing the electromagnetic actuator 124 which is arranged normal to the rack 134, the actuator presses the rack 134 into the gear of the electric motor 136 or into the gear wheel 148. Subsequently, by energizing the electric motor 136, the separating element 116 is moved out between the two contact pieces 102, 104, thereby preloading the spring 132. At a defined position, rack 134 has a hole or a recess 158, into which the actuator 124, which is still energized, can be immersed. This mechanism separates the rack 134 and the gear of the electric motor 136 and the gear wheel 148 and locks the separating element 116. Compared to the solution known from the prior art, the electrical switch 100 has the decisive advantage that no electromagnetic actuator is required which has to hold the entire force of the pretensioned spring 132. This results in significantly lower holding currents which allow the actuator or the actuator unit 118 is considerably smaller, lighter and therefore more cost-effective.

The electromagnetic actuator 124 can either be mono or bistable, depending on the intended use. This property would then also be directly transferred to the electrical switch 100, also known to as a contactor. In the following, a monostable arrangement is assumed.

By switching off the control current on the electromagnetic actuator 124, the actuator 124 is removed from the hole (recess 158) in the rack 134 by a return spring 152. Then the separating element 116 then snaps between the contacts (contact pieces 102, 104) of switch 100. The electrically conductive top 142 of that separating element 116 lifts off the movably designed second contact piece 104. However, since the current can initially continue to flow via the electrically conductive top 142, no switching arc initially occurs at the contact area (contact point 106) of the closed switch 100. The contact point 106 is thus spared. A switching arc only occurs when the conductive top 142 has moved completely past the flexible second contact piece 104. It is then created between this second contact piece 104 and the conductive top 142. To suppress this arc, the separating element 116 is then immediately immersed in a recess in the base plate 144. There the arc is strongly cooled and collapses.

All these measures result in a significantly higher overall disconnection capacity of "hard" short circuits compared to the solutions known in the prior art, so that a previous HV fuse can be omitted, which in turn enables the reduction of line cross sections.

In addition to the arrangement described above according to FIG. 1 to FIG. 3, it is also conceivable, as shown in the following FIG. 4 and FIG. 5, to place the actuator unit 118 between the connection contacts. However, the arrangement described above and shown in FIG. 1 to FIG. 3 has the advantage that the actuator unit 118 and the switching region with the contacts are spatially separated. This allows higher contact connection temperatures to be tolerated. In addition, the contact lengths can be reduced in this way. There is also another advantage of the first version according to FIG. 1 to FIG. 3, since the electromagnetic Lorentz force there additionally increases the contact force when energized.

Depending on the dimensioning of the arrangement, it can be designed for low voltages in the range 40-60 V for especially 48 V applications or for HV applications with voltages in the range ~400-1000 V. Furthermore, the electrical switch 100 can be designed in steps so that it can be used for different maximum separation currents. Since, in contrast to the solutions known in the prior art, it is not a contact itself but a third element (here: separating element 116) that is actuated, different conductor cross sections can be used with almost the same actuator arrangement.

The electromagnetic actuator 124 and the electric motor 136 are generally controlled via control connections not shown here and sequential energization sequence of electromagnetic actuator 124 and electric motor 136 is realized by external electronics.

Optionally, a terminal current measurement for condition monitoring can also be integrated in addition to the electrical switch 100 to display diagnostic capability. Furthermore, a condition monitoring can be set up by the above described position detection of the bolt from the electromagnetic actuator.

In a special design, an external precharging circuit, as currently connected in parallel to the electrical switch 100 on the positive side, can be integrated into the electronics. In the prior art, this precharge circuit consists of a relay and a resistor. When the system is switched on, the relay is first switched through so that the components installed in the system, especially the capacitors, are not immediately loaded with the full operating current. This precharge circuit can be replaced by a resistor and a power semiconductor for integration into the electronics of the switch.

Figure 4:
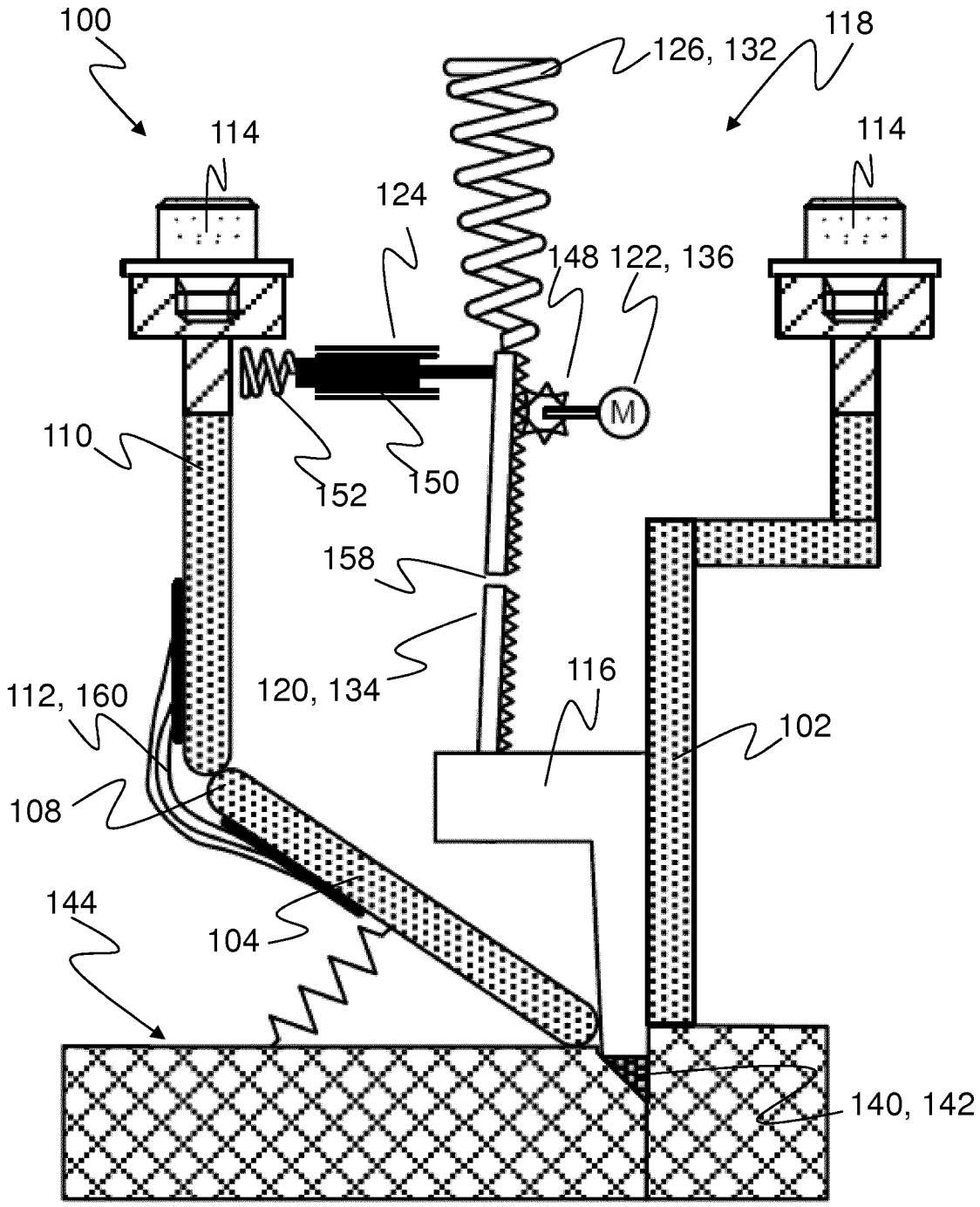
FIG. 4-5 is a schematic representation of an electrical switch according to a second example of the present disclosure.
Figure 5:
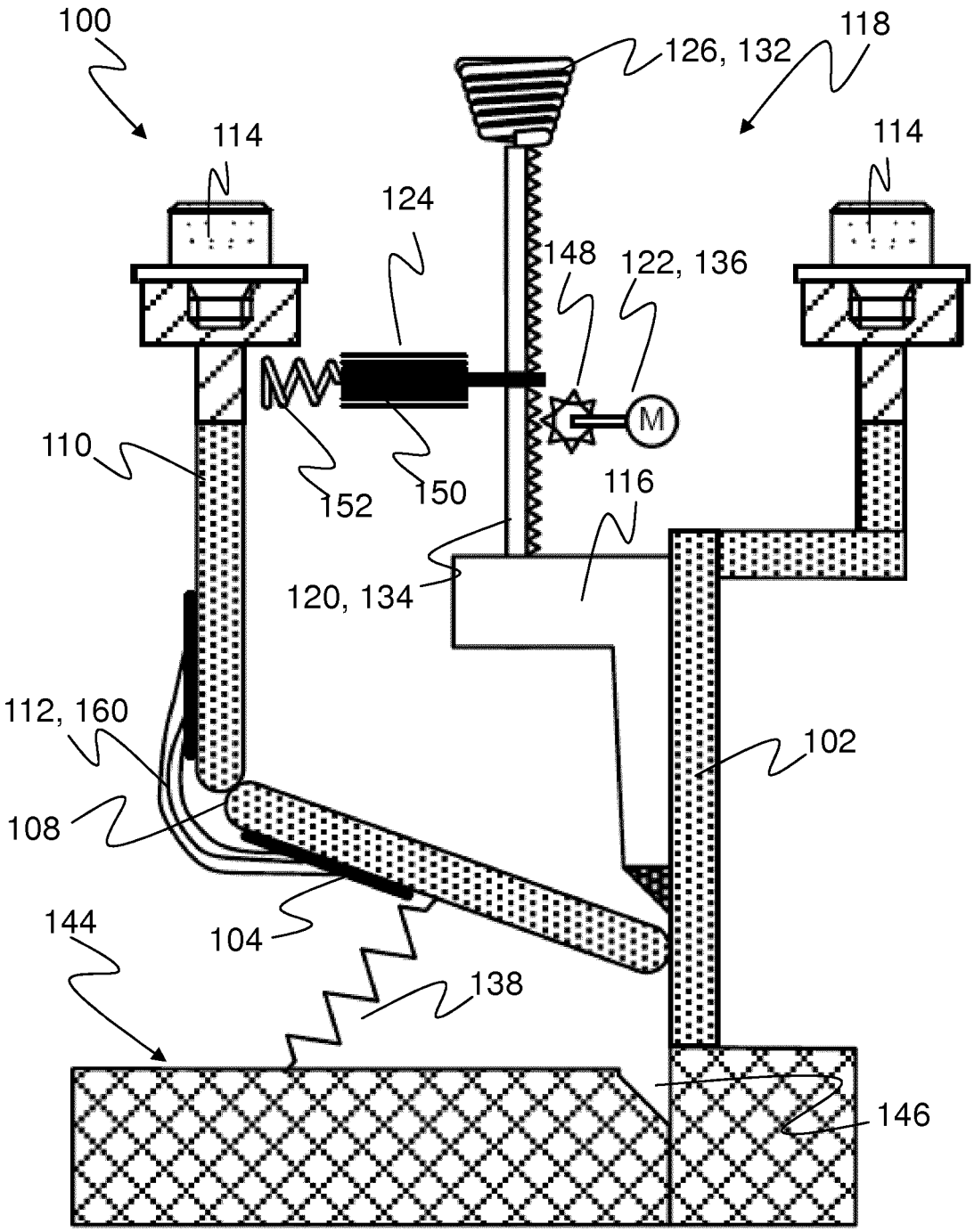

In the second exemplary embodiment of an electrical switch 100 shown in FIG. 4 and FIG. 5, the actuator unit is arranged between the first contact piece 102 and the third contact piece 110. As in the first exemplary embodiment, with respect to the second contact piece 104, a base plate 144 with a recess 146 is arranged on the side opposite the separating element 116. The contact pressure spring 138 is arranged between the second contact piece 104 and the base plate 144, in order to bring the second contact piece 104 back into electrical and mechanical contact with the first contact piece 102 when the electrical switch 100 closes, or to hold it in 102, 104 when electrical and mechanical contact between the two contact pieces is established. When the electrical switch 100 is closed the second contact piece 104 is arranged in at an angle with respect to the first contact piece 102. The corresponding angle between the first contact piece 102 and the second contact piece 104 is usually between 10° and 80°, whereas the corresponding angle is preferably between 20° and 45°. The incline of the top 142 of the separating element 116 is in relation to said angle. The top 142 preferably has an acute angle.

Figure 6:
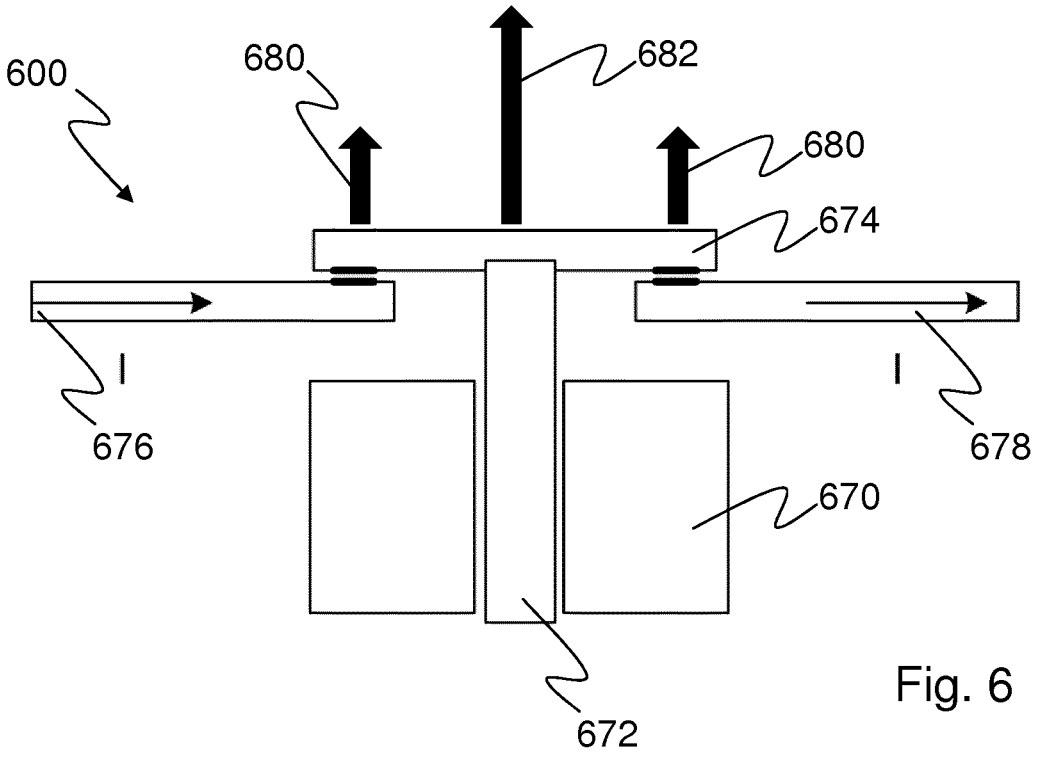
FIG. 6-7 is a schematic representation of the mode of action of Holm's narrow force and Lorentz force.

As already mentioned above, a particular advantage of the electrical switch 100, 600 described here can be seen in the way in which Holm's narrow force and Lorentz force act on the electrical switch 100, 600. For this purpose, FIG. 6 shows a classic contactor 600. The current flow is symbolically represented by arrows marked with i. Arranged in a coil 670 is a translationally movable armature 672, which is arranged to connect a first busbar 676 to a second busbar 678 by means of a contact piece 674. When the contactor 600 is closed, the contact between the contact piece 674 and the two busbars 676, 678 is closed. In the representation according to FIG. 6, the contact piece 674 moves up in the drawing plane to open the contactor 600. Holm's narrow force 680 acts upwards in the drawing plane at contact points between the bell 674 and the two busbars 676, 678. The Lorentz force 682 acts upwards on the contact piece 674 in the drawing plane. Thus, the Lorentz force 682 and the Holm narrow force 680 act in the same direction, which corresponds to the direction of movement for opening the contactor 600.

Figure 7:
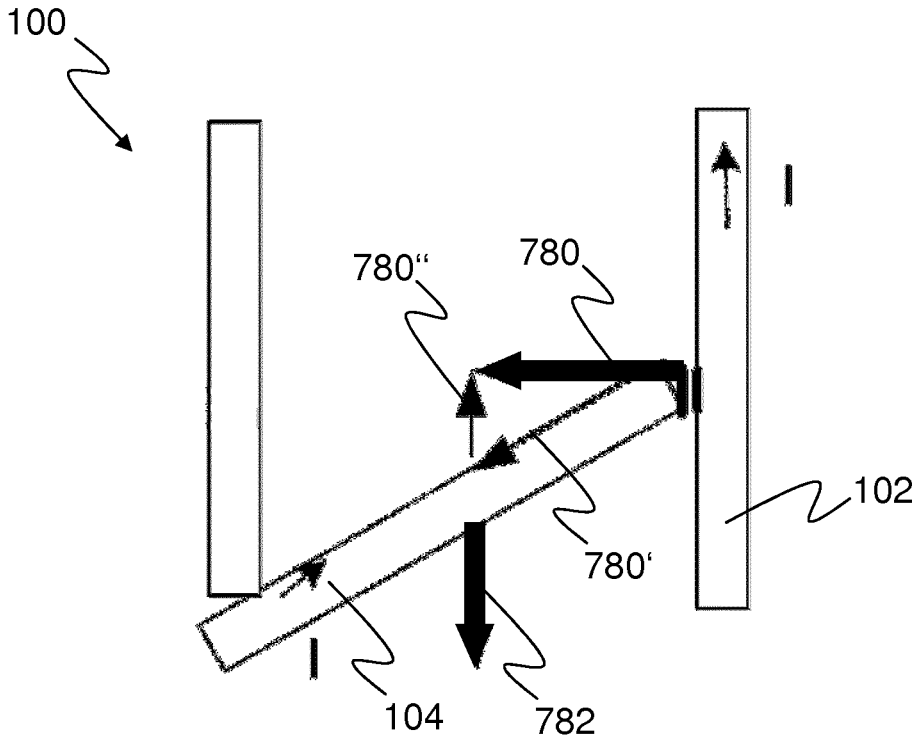

The Holm's narrow force 680 and the Lorentz force 682 are different for an electrical switch 100, as is shown in the first exemplary according to FIG. 1 to FIG. 3 is shown. The corresponding force arrows are shown in a simplified representation of such an electrical switch 100 in FIG. 7. The tightening force 780 acts vertically on the contact point 106 of the first contact piece 102 in the direction of the third contact piece 110. Thereby the tightening force 780 can be vectorially considered. A first force vector 780' of the tightening force 780 acts along the second contact piece 104, at the top of which a second force vector 780" is applied and closes the force triangle to the top of the vector of the tightening force 780. The second force vector 780" is perpendicular to the orientation of the tightening force 780 or in other words parallel to the first contact piece 102. The first force vector 780' runs from contact point 106 along the main direction of extension of the second contact piece 104. The Lorentz force 782 acts on the second contact piece 104, whereby the direction of the Lorentz force 782 is exactly opposite to the second force vector 780".

Since the devices described in detail above are examples of design, they can be modified in an usual way by a skilled person to a large extent without leaving the field of the disclosure. In particular, the mechanical arrangements and the proportions of the individual elements to one another are only shown as examples.

The invention claimed is:

1. An electrical switch for interrupting a current path, comprising:

a contact point;

a first contact piece; and a second contact piece mounted so as to be movable about an axis of rotation;

wherein the contact point is electrically closed when the first and second contact pieces are in contact, and wherein the contact point is electrically open when the first and second contact pieces are not in contact, wherein the electrical switch further comprises:

an actuator units;

an electrically non-conductive separating element which is moved in translation by means of the actuator unit and which is arranged to separate the first and second contact pieces from one another, to keep them separate and to act as an insulator between contact surfaces, wherein the actuator unit comprises:

a moving element which is mechanically coupled to the separating element, a drive device arranged to move the moving element in a first direction of movement to close the contact point, a device for at least one of generating and storing a kinetic energy in the form of potential energy, which is arranged to move at least one of the moving element and the separating element in a second direction of movement opposite to the first direction of movement in order to open the contact point, and an electromagnetic actuator which is arranged:

in a first operating state to at least one of block a movement of the moving element in the second direction of movement and lock the moving element in a defined position and thereby holding the moving element in a rest position in order to keep the contact point closed, and in a second operating state to move the moving element in a direction of the drive device and to couple the moving element mechanically with the drive device so that the moving element is moved by means of the drive device in the first direction of movement in order to close the contact point, and in a third operating state, to release the moving element so that the moving element and the separating element are moved by the device for at least one of generating and storing a kinetic energy in the form of potential energy which is movable in the second direction of movement in order to open the contact point and/or so that the contact point is opened.

2. The electrical switch according to claim 1, in which the current path is a current path of a power supply in a motor vehicle.

3. The electrical switch according to claim 1, wherein an inclined section of the separating element extends obliquely to a direction of movement and a main direction of extension of the separating element, in the form of a tip, ramp or slope, so that when moving in the second direction of movement, the second contact piece is disconnected from the first contact piece via the tip, ramp or slope.

4. The electrical switch according to claim 3, wherein the inclined section of the separating element is made of conductive resistive material.

5. The electrical switch according to claim 3, in which, when the separating element moves in the second direction of movement, the extension of the separating element is immersed in an electrically insulating base plate after the two contact pieces have been disconnected.

6. The electrical switch according to claim 5, wherein the base plate has a recess which substantially corresponds to the shape of the extension of the separating element and is shaped such that the extension of the separating element substantially fills the recess when the extension of the separating element is immersed in the base plate.

7. The electrical switch according to claim 1, wherein an electrical resistance of the separating element is selected to limit transients during inrush currents.

8. The electrical switch according to claim 1, wherein the separating element comprises ceramic material.

9. The electrical switch according to claim 1, wherein the drive device is formed as an electric motor or an electric motor with a transmission.

10. The electrical switch according to claim 1, in which the device for at least one of generating and storing a kinetic energy is designed as a spring.

11. The electrical switch according to claim 1, in which the moving element is formed as a rack or as a spindle.

12. The electrical switch according to claim 11, wherein the rack has a recess, bore or cavity shaped to be engaged by an element of the electromagnetic actuator when the electromagnetic actuator is in the first operating state.

13. The electrical switch according to claim 1, in which at least one of the electromagnetic actuator is designed as a solenoid and the device for at least one of generating and storing a kinetic energy comprises a force storage drive or a tension spring.

14. The electrical switch according to claim 13, wherein the solenoid is formed as a monostable solenoid.

15. The electrical switch according to claim 1, in which the first contact piece has an insulating jacket in the region of the contact point.

16. The electrical switch according to claim 1, comprising a control device for controlling the operating states of the electromagnetic actuator and the drive device, the control device having respective control terminals.

17. The electrical switch according to claim 1, comprising a condition monitoring device by means of at least one of terminal current measurement and position detection of a movable element of the electromagnetic actuator.

18. The electrical switch according to claim 1 further comprising a precharge circuit.

19. The electrical switch according to claim 18, wherein the precharge circuit comprises a resistor and a power semiconductor.

* * * * *